US008496023B2

(12) United States Patent
Honda

(10) Patent No.: US 8,496,023 B2
(45) Date of Patent: Jul. 30, 2013

(54) TEMPORARY DRAINAGE SYSTEM AND TEMPORARY DRAINAGE METHOD

(75) Inventor: Tsuyoshi Honda, Yokosuka (JP)

(73) Assignee: Toshiba Plant Systems & Services Corporation, Tokohama-Shi (JP)

( * ) Notice: Subject to any disclaimer, the term of this patent is extended or adjusted under 35 U.S.C. 154(b) by 355 days.

(21) Appl. No.: 12/935,123

(22) PCT Filed: Mar. 23, 2009

(86) PCT No.: PCT/JP2009/055688

§ 371 (c)(1),
(2), (4) Date: Sep. 28, 2010

(87) PCT Pub. No.: WO2009/119518

PCT Pub. Date: Oct. 1, 2009

(65) Prior Publication Data

US 2011/0023967 A1 Feb. 3, 2011

(30) Foreign Application Priority Data

Mar. 28, 2008 (JP) ..... 2008-087220

(51) Int. Cl.
*F16L 5/00* (2006.01)

(52) U.S. Cl.
USPC ..... 137/357; 137/363; 137/546; 137/271; 52/302.1

(58) Field of Classification Search
USPC ..... 137/357, 363, 546, 269, 271; 52/302.1
See application file for complete search history.

(56) References Cited

U.S. PATENT DOCUMENTS

| | | | | |
|---|---|---|---|---|
| 4,245,666 | A * | 1/1981 | Norris | 137/357 |
| 4,372,757 | A * | 2/1983 | Favret, Jr. | 210/776 |
| 4,934,404 | A * | 6/1990 | DeStefano | 137/357 |
| 8,141,322 | B2 * | 3/2012 | Appel | 52/742.1 |
| 8,230,653 | B2 * | 7/2012 | Hoshi | 52/302.1 |
| 2004/0040598 | A1 * | 3/2004 | Zimmerman et al. | 137/357 |
| 2008/0272064 | A1 * | 11/2008 | Leonard | 210/760 |
| 2008/0313993 | A1 * | 12/2008 | Reen | 52/718.01 |
| 2011/0017301 | A1 * | 1/2011 | Canavan | 137/1 |

FOREIGN PATENT DOCUMENTS

| | | |
|---|---|---|
| EP | 2 267 245 A1 | 12/2010 |
| JP | 6 85860 | 12/1994 |
| JP | 2004-84414 | 3/2004 |
| JP | 2007-146615 | 6/2007 |

OTHER PUBLICATIONS

International Preliminary Report on Patentability dated Dec. 2, 2010 in corresponding International Application No. PCT/JP2009/055688 filed on Mar. 23, 2009 (submitting English translation only).
International Search Report issued May 26, 2009 in PCT/JP09/055688 filed Mar. 23, 2009.
The Extended European Search Report issued Sep. 10, 2012, in Application No. / Patent No. 09723986.7-2303 / 2267244.

* cited by examiner

*Primary Examiner* — John Rivell
*Assistant Examiner* — Ian Paquette
(74) *Attorney, Agent, or Firm* — Oblon, Spivak, McClelland, Maier & Neustadt, L.L.P.

(57) ABSTRACT

A temporary drainage system for draining rain water that flows into a floor under construction to an outside of a building during construction of a multiple-story building includes: a flexible drainage collection hose connected to a penetration hole formed in a floor slab of the floor under construction; a sand-settling vessel provided on a floor slab of a constructed floor of the building and connected to the drainage collection hose; a drainage pit provided on a lowest floor of the building to store drainage water discharged from the sand-settling vessel through a drainage hose; and a drainage pump provided in the drainage pit. The drainage water collected into the drainage pit is discharged to the outside of the building by an operation of the drainage pump.

6 Claims, 6 Drawing Sheets

TEMPORARY DRAINAGE SYSTEM AND TEMPORARY DRAINAGE METHOD

TECHNICAL FIELD

The present invention relates to a temporary drainage system and temporary drainage method for draining rain water that flows into a building under construction such as a reactor building of a nuclear power plant to outside the building.

BACKGROUND ART

When a concrete multiple-story (or multiple-floor) building such as a high-rise building and a reactor building is constructed, the building is constructed by casting concrete sequentially from a lowest floor. For example, casting of concrete in a second floor portion is started after casting working of concrete in a first floor portion has been completed by constructing a slab in a ceiling portion of the first floor (a floor portion of the second floor).

It is not preferable that rain water or the like flows into a lower floor that has already been constructed during construction or another work of a floor above the lower floor that has already been constructed. Particularly, to improve construction efficiency, interior finish work or installation of a reactor or equipment may be started in the floor that has already been constructed. In such case, it is strictly essential to prevent the rain water from flowing into the floor.

Generally, one of floors that have already been constructed is employed as a water stop floor to prevent rain water from flowing into downstairs' floors of the water stop floor. The rain water stored on a floor slab of the water stop floor is drained by a pump or the like.

FIG. 6 is a schematic configuration diagram illustrating a conventional drainage system.

As shown in FIG. 6, a conventional temporary drainage system 70 is provided in a reinforced concrete or steel-reinforced concrete multiple-story building 1 under construction. In the multiple-story building 1, a first floor 72 and a second floor 73 have been constructed, and a third floor 74 is being constructed. For example, the second floor 73 is employed as the water stop floor. Rain water flowing from the third floor 74 and floors above the third floor 74 is stopped on a floor slab 75 of the second floor 73 (a ceiling slab of the first floor), to prevent rain water from flowing into the first floor.

Accordingly, the rain water flowing from the upper floors is stopped at the water stop floor, and does not flow into the first floor 72. The rain water stored on the floor slab 75 is discharged by a pump 76 to the outside of the building from an opening 79 for a window formed in a side wall 78 of the second floor 73 through a hose 77 (for example, see Patent Document 1: Japanese Patent Laid-Open No. 2004-84414).

The concrete multiple-story building such as a reactor building has a plurality of rooms on one floor. In the concrete multiple-story building described above, when an upper floor under construction is employed as the water stop floor, drainage water such as rain water is stored in the plurality of rooms, and a drainage pump needs to be installed in each of the rooms. Thus, it is difficult to effectively discharge the drainage water to the outside from the multiple-story building.

It takes as long as a few years to construct the concrete multiple-story building such as a reactor building, and during the construction period, sand or the like is mixed into the drainage water, and the sand mixed into the drainage water may clog the drainage pump, which may make it difficult to discharge the drainage water.

DISCLOSURE OF THE INVENTION

An object of the present invention is to provide a temporary drainage system and temporary drainage method capable of effectively discharging drainage water over long periods with a simple structure in a concrete multiple-story building under construction.

To achieve the above object, in one aspect, the present invention provides a temporary drainage system for draining outside rain water or the like that flows into a floor under construction during construction of a multiple-story building, comprising a drainage collection unit and a drainage discharge unit, the drainage collection unit comprising:

a flexible drainage collection hose connected to a penetration hole provided in a floor slab of the floor under construction;

a drainage collection vessel provided on a floor slab of a constructed floor below the floor under construction of the building and connected to the drainage collection hose; and a drainage pit provided on a lowest floor of the building to collect drainage water discharged from the drainage collection vessel through a drainage hose, and the drainage discharge unit comprising:

a drainage pump provided in the drainage pit; and a drainage pipe connected to the drainage pump.

In the temporary drainage system, the drainage collection unit may further comprise a drainage collection funnel provided in a floor slab of a constructed floor of the building, a drainage collection riser pipe buried in the floor slab of the building and a side wall of the building may be connected to the drainage collection funnel, and drainage water discharged from the drainage collection vessel may be collected into the drainage pit through the riser pipe.

The drainage collection hose may be connected to the penetration hole through a hose guide pipe.

The drainage collection vessel may be a sand-settling vessel for separating water and sand.

To achieve the above object, in another aspect, the present invention provides a temporary drainage method for draining outside rain water or the like that flows into a floor under construction during construction of a multiple-story building, comprising the steps of: providing a penetration hole in a floor slab of the floor under construction of the building; draining water such as rain water on the floor slab through a drainage hose connected to the penetration hole; collecting the drainage water into a vessel provided on a floor slab of a constructed floor of the building; collecting the drainage water discharged from the vessel into a drainage pit provided on a lowest floor of the building; and discharging the drainage water from the drainage pit to outside the building.

The temporary drainage method may further comprise the step of closing the penetration hole after completion of final drainage.

The vessel may separate water and sand.

According to the present invention having the characteristic features mentioned above, there is provided a temporary drainage system and a temporary drainage method capable of effectively discharging drainage water over long periods with a simple structure in a concrete multiple-story building under construction.

BEST MODE FOR CARRYING OUT THE INVENTION

In the following, an embodiment of a temporary drainage system according to the present invention will be described with reference to FIGS. 1 to 5.

Figure 1:
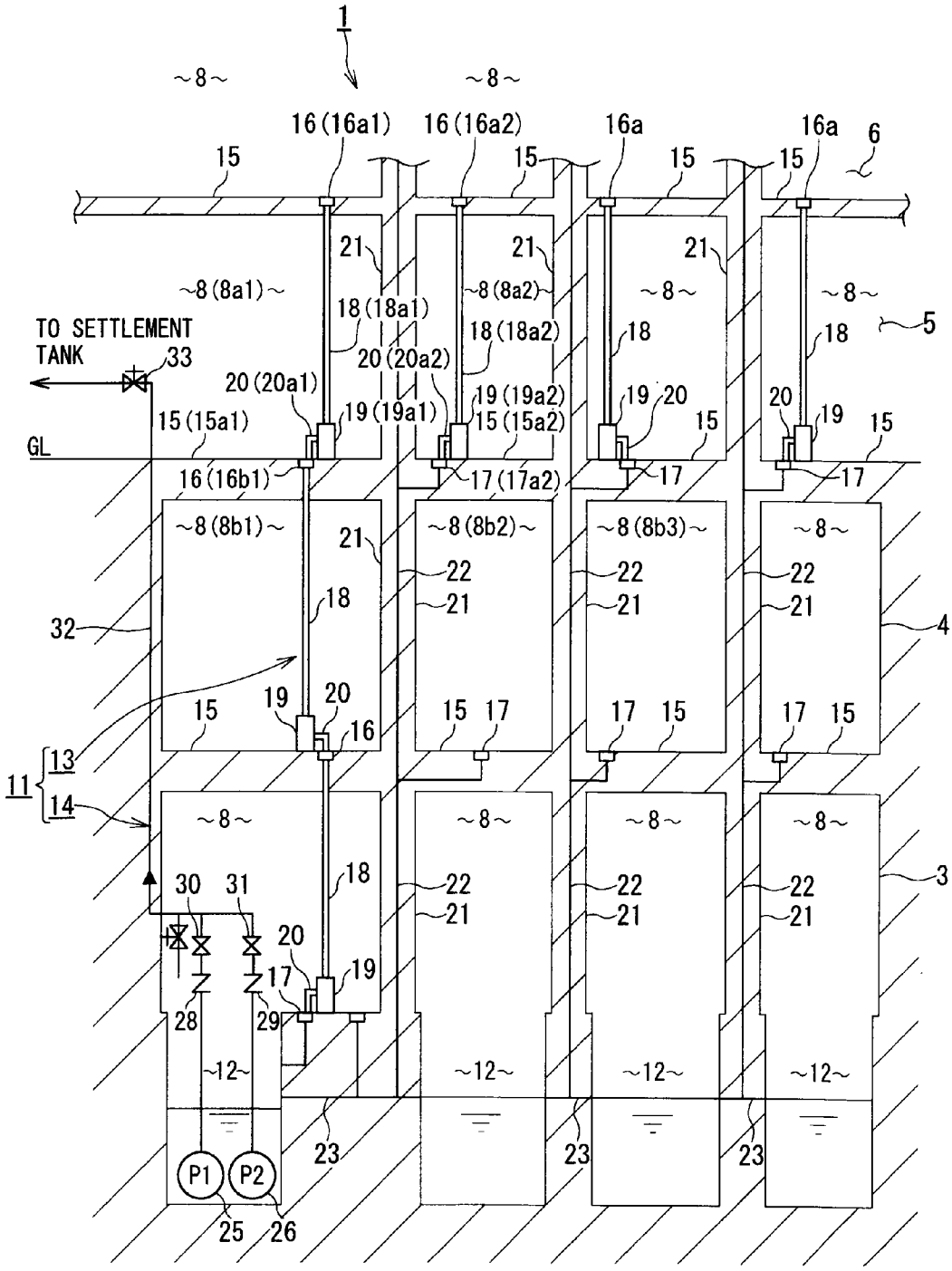
FIG. 1 is a schematic view of a multiple-story building under construction to which a temporary drainage system according to the present invention is applied.

FIG. 1 shows a building under construction, in which a multiple-story building 1 is a reinforced concrete reactor building, which is of substantially square shape having about 100 m on each side in a plan view of the multiple-story building 1 in the present embodiment.

In the multiple-story building 1 shown in FIG. 1, a second basement floor 3, a first basement floor 4, and a first floor 5 have been already constructed, and a second floor 6 is under construction.

A plurality of rooms 8 are provided on each of the floors of the multiple-story building 1 under construction, and for example, the total number of rooms 8 is about 500 in a case where the multiple-story building 1 is the reactor building. The rooms 8 include an electrical room in which electrical equipment is housed (for example, the rooms 8 (8*b*2) and 8 (8*b*3) on the first basement floor in FIG. 1).

A temporary drainage system 11 is provided in the multiple-story building 1.

The temporary drainage system 11 includes a drainage collection unit 13 for collecting drainage water within the multiple-story building 1 into a drainage pit 12, and a drainage discharge unit 14 for discharging the drainage water collected into the drainage pit 12 to the outside of the multiple-story building 1. The drainage pit 12 is provided on a lowest floor of the multiple-story building 1.

The drainage collection unit 13 includes a penetration structure having a floor slab penetration hole 16 in a floor slab 15 of each of the rooms 8. The drainage collection unit 13 may include a funnel structure having a drainage collection funnel 17 depending on the structure of the building.

The floor slab penetration hole 16 is provided so as to communicate the room 8 on a given floor with the room 8 on the floor below the given floor. One end of a flexible collection hose 18 is removably connected to the floor slab penetration hole 16. The other end of the collection hose 18 is connected to a sand-settling vessel 19. The sand-settling vessel 19 is provided on the floor slab 15 of the floor below. Drainage water supplied from the floor above is temporarily stored in the sand-settling vessel 19.

The sand-settling vessel 19 can store a substance such as sand and dirt having a higher specific gravity than water contained in the drainage water and discharge drainage water mainly containing liquid. The drainage water discharged from the sand-settling vessel 19 is discharged to the floor below through the floor slab penetration hole 16 provided in the floor slab 15 from a discharge hose 20. The discharge hose 20 is connected to the sand-settling vessel 19. The drainage water is sequentially conveyed to the lower floors in a repeated manner to finally reach the drainage pit 12.

The above configuration will be more specifically described hereunder with reference to FIG. 1.

The floor slab penetration structure in the drainage collection unit 13 includes the penetration hole 16 (16*a*1) formed in the floor slab 15 to bring a room on the second floor 6 under construction and the room 8 (8*a*1) on the constructed first floor 5 into communication with each other, for example. The collection hose 18 (18*a*1) connected to the floor slab penetration hole 16 (16*a*1) is connected to the sand-settling vessel 19 (19*a*1) provided on the floor slab 15 (15*a*1) of the room 8 (8*a*1) on the first floor 5. The discharge hose 20 (20*a*1) of the sand-settling vessel 19 (19*a*1) is connected to the floor slab penetration hole 16 (16*b*1) provided in the floor slab 15 (15*a*1). The drainage water is repeatedly conveyed to the lower floors to reach the drainage pit 12.

In the present invention, the drainage collection funnel structure may be employed instead of the above penetration hole structure depending on the type of the building. For example, in a case where a building includes a room in which it is strictly required to prevent, such as a room in which electrical equipment or the like is provided, even in the temporary system.

For example, the drainage collection funnel structure having the drainage collection funnel 17 (17*a*2) is provided in the ceiling floor slab 15 (15*a*2) of the room 8 (8*b*2) with electrical equipment or the like formed on the first basement floor 4 of the building in FIG. 1. The drainage collection funnel 17 (17*a*2) is connected to a drainage collection riser pipe 22. The drainage collection riser pipe 22 is buried in the floor slab 15 (15*a*2) and a side wall 21 of the room 8 (8*b*2). The drainage collection riser pipe 22 is connected to a pit communicating pipe 23 in the side wall of the lowest floor.

In the structure of FIG. 1, in a case where the drainage water is discharged from the drainage collection funnel 17 to the drainage pit 12, the collection hose 18 (18*a*2), the sand-settling vessel 19 (19*a*2) and the discharge hose 20 (20*a*2) are serially connected from the floor slab penetration hole 16 (16*a*2) of the floor (the second floor) above the drainage collection funnel 17 (17*a*2) that is provided in the room 8 (8*a*2) on the first floor. The discharge hose 20 (20*a*2) is connected to the drainage collection funnel 17 (17*a*2). Accordingly, a substance such as sand having a higher specific gravity than water is separated by the sand-settling vessel 19 (19*a*2) from the drainage water, which is discharged to the drainage collection funnel 17 (17*a*2), and collected into the drainage pit 12.

The drainage pit 12 is provided in almost four corners of the second basement floor 3 as the lowest floor. The drainage pits 12 are provided such that a maximum water level of the stored water is lower than a floor position of the second basement floor 3 as the lowest floor. The drainage pits 12 communicate with each other through the pit communicating pipe 23, so that the water storage amount in each of the drainage pits 12 is maintained at substantially the same level as each other.

A first drainage pump 25 with small output and a second drainage pump 26 with large output are provided in the drainage pit 12 as the drainage discharge unit 14. The first drainage pump 25 and the second drainage pump 26 are connected to a drainage discharge pipe 32 via check valves 28 and 29, and gate valves 30 and 31, respectively. The drainage discharge pipe 32 is connected to a settlement tank via a gate valve 33.

Although the first drainage pump 25 and the second drainage pump 26 are provided in the present embodiment, only one of the drainage pumps may be employed.

Figure 2:
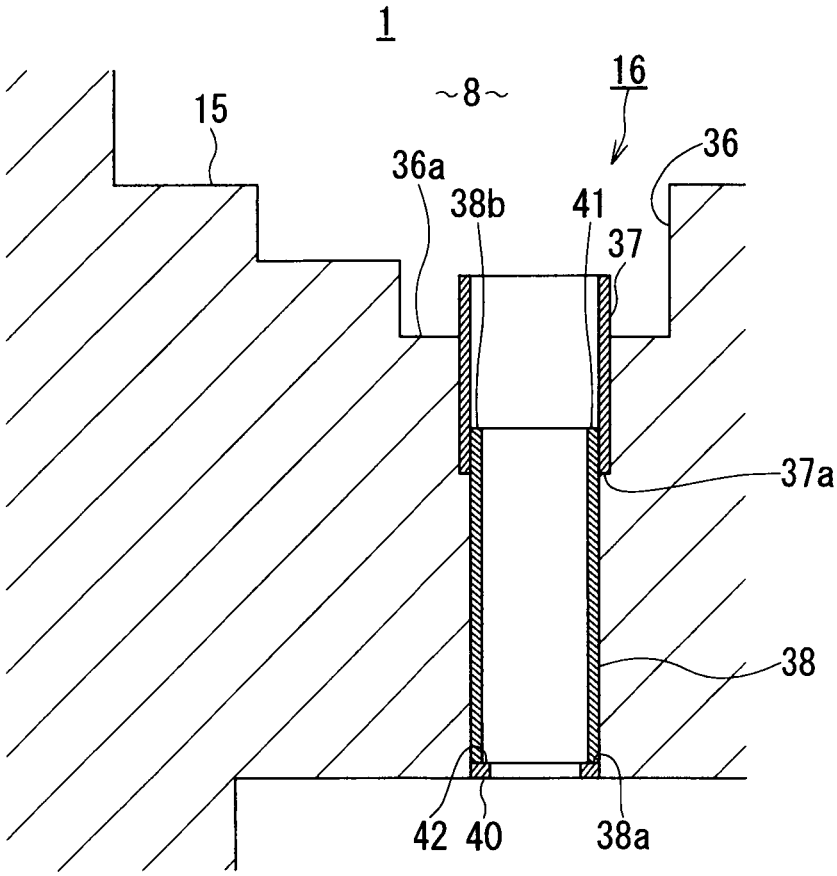
FIG. 2 is a partial sectional view of the multiple-story building illustrating a structure of a hole penetrating a floor slab (called floor slab penetration hole structure, hereinlater) of the temporary drainage system according to the present invention.

FIG. 2 is a partial sectional view of the multiple-story building illustrating the floor slab penetration structure of the temporary drainage system according to the present invention.

As shown in FIG. 2, the floor slab penetration hole 16 is formed in the floor slab 15 of the multiple-story building 1 under construction.

The floor slab penetration hole 16 is formed so as to penetrate the floor slab 15 at the same time of casting concrete to form the floor slab 15.

The floor slab penetration hole 16 includes a substantially cylindrical funnel portion 36 that opens in a floor surface of the room 8. A connection pipe portion 37 is inserted from a bottom portion of the funnel portion 36, and a hose guide pipe portion 38 is inserted into a lower end of the connection pipe portion 37 to communicate therewith. An inner flange portion 40 extending inward is provided substantially flush with a ceiling surface of the lower floor in a lower end portion 38*a* of the hose guide pipe portion 38.

One end (an upper end in the illustration) of the connection pipe portion 37 projects upward from a bottom portion 36*a* of the funnel portion 36, and a lower end thereof is appropriately buried in the floor slab 15. However, an end edge portion at the upper end of the connection pipe portion 37 does not project upward from the floor slab 15 over the penetration hole 16.

An outer diameter of the hose guide pipe portion 38 is slightly smaller than an inner diameter of the connection pipe portion 37. An upper end portion 38*b* of the hose guide pipe portion 38 is appropriately inserted into a lower end portion 37*a* of the connection pipe portion 37. Accordingly, a step portion 41 is formed by the upper end portion 38*b* of the hose guide pipe portion 38 inside the connection pipe portion 37. A step portion 42 is also formed by the inner flange portion 40 in the lower end portion 38*a* of the hose guide pipe portion 38.

At least the inner flange portion 40 is made of stainless steel.

In the embodiment illustrated in the drawing, the funnel portion 36 is preferably of cylindrical shape, and a diameter of an opening portion of the penetration hole is preferably about 200 mm. However, other shapes and dimensions may be appropriately employed as occasion demands.

Figure 3:
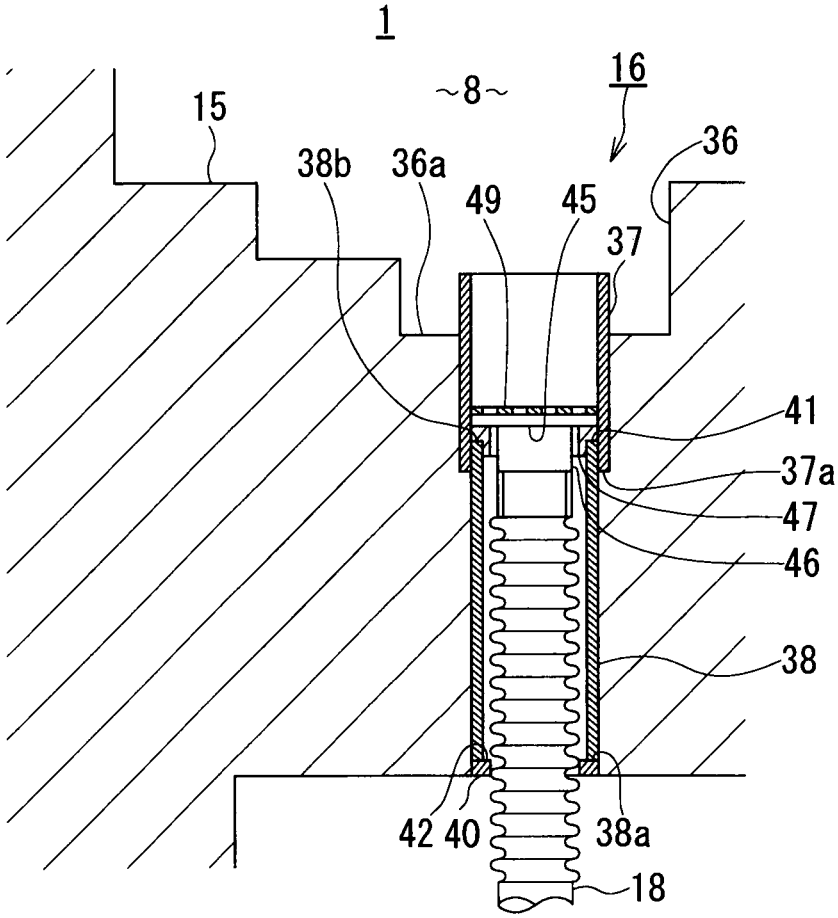
FIG. 3 is a partial sectional view of the multiple-story building illustrating a state in which a collection hose is connected to a floor slab penetration hole of the temporary drainage system according to the present invention.

FIG. 3 is a partial sectional view of the multiple-story building illustrating a state in which the collection hose is connected to the floor slab penetration hole of the temporary drainage system according to the present invention.

As shown in FIG. 3, the collection hose 18 is connected to the floor slab penetration hole 16 formed in the floor slab 15 of the multiple-story building 1 under construction.

A hose connector portion 46 having a flange portion 45 is provided at an end portion (an upper end portion in FIG. 3) of the collection hose 18.

The collection hose 18 is held by bringing the flange portion 45 of the hose connector portion 46 into abutment against the step portion 41 of the floor slab penetration hole 16 via a seal ring 47. When the collection hose 18 is connected to the floor slab penetration hole 16, a grating 49 is provided above the hose connector portion 46.

Figure 4:
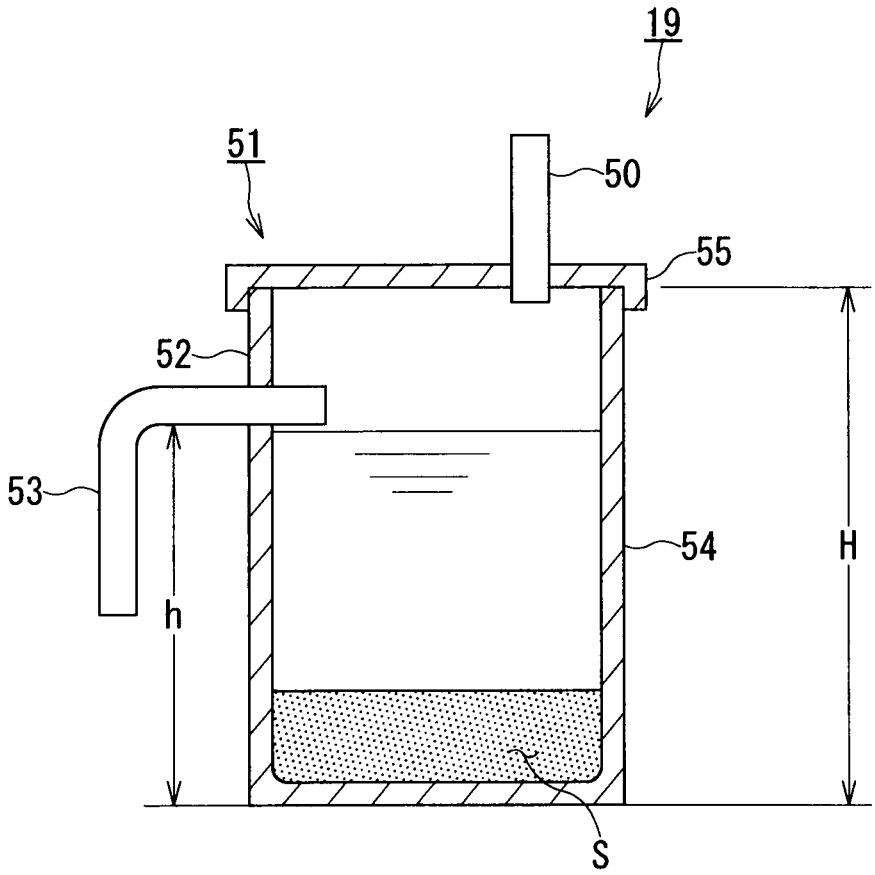
FIG. 4 is a sectional view of a sand-settling vessel of the temporary drainage system according to the present invention.

FIG. 4 is a sectional view of the sand-settling vessel of the temporary drainage system according to the present invention.

As shown in FIG. 4, the sand-settling vessel 19 of the temporary drainage system 11 includes an inflow pipe portion 50 to which the other end portion of the collection hose 18 (a lower end portion in FIG. 3) is connected, a vessel portion 51 where the drainage water flowing through the inflow pipe portion 50 is temporarily stored, and a discharge pipe portion 53 provided in a side wall portion 52 of the vessel portion 51 and connected to the discharge hose 20.

The vessel portion 51 includes a vessel body 54 having an upper end opened and a lid member 55 to close the opening of the vessel body 54. The inflow pipe portion 50 is provided in the lid member 55. The discharge pipe portion 53 is provided at a height h that is about the half to ¾ ($\frac{1}{2}H \leqq h \leqq \frac{3}{4}H$) of a height H of the side wall portion 52 of the vessel body 54. Accordingly, a large capacity for storing sand S or the like is secured in the vessel body 54, and even if a large amount of drainage water temporarily flows into the vessel body 54, the drainage water does not easily overflow from the vessel body 54.

Although an outer shape of the vessel body 54 is not limited to a particular shape, a cylindrical vessel or a box-shaped vessel may be preferably used herein.

In the temporary drainage system 11 according to the present embodiment, when it rains on the multiple-story building 1, rain water first falls onto the floor slab 15 of the second floor 6 under construction. The rain water falling onto the floor slab 15 of the second floor 6 flows into the floor slab penetration hole 16*a* as the drainage water containing sand and dirt. The drainage water flowing into the floor slab penetration hole 16*a* is temporarily stored in the sand-settling vessel 19*a* through the collection hose 18*a*. The substance such as sand and dirt having a higher specific gravity than water contained in the drainage water settles to the bottom of the sand-settling vessel 19*a* to be stored therein. The drainage water mainly containing liquid from which the substance such as sand and dirt having a higher specific gravity than water is removed is discharged from the sand-settling vessel 19*a*, and flows into the floor slab penetration hole 16*b* or the drainage collection funnel 17 provided in the floor slab 15*a*1 (15*a*2) from the discharge hose 20*a*. The drainage water flowing into the floor slab penetration hole 16*b* is repeatedly conveyed to the lower floors to reach the drainage pit 12. Alternatively, the drainage water flowing into the drainage collection funnel 17 is conveyed to the lower floors through the drainage collection riser pipe 22 and flows into the pit communicating pipe 23 to reach the drainage pit 12.

The drainage water stored in the drainage pit 12 is conveyed to the settlement tank through the drainage discharge pipe 32 by the first drainage pump 25 and the second drainage pump 26 provided in the drainage pit 12. At this time, all the gate valves 30, 31 and 33 are opened. When the storage amount of the drainage water in the drainage pit 12 is at a predetermined level or less, the first drainage pump 25 with small output is mainly operated to discharge the drainage water. When a drainage water flow rate into the drainage pit increases to cause the drainage water storage amount to exceed the predetermined level, the second drainage pump 26 with large output is operated together with the first drainage pump 25 to discharge the drainage water.

Therefore, the drainage water such as rain water does not flow into the floor surfaces of the floors below a given floor under construction. For example, during construction of the second floor 6, the drainage water does not flow into the floor surfaces of the second basement floor 3, the first basement floor 4 and the first floor 5 that have already been constructed. Particularly, in the case where interior finish work or installation of a reactor or equipment is started in the second basement floor 3, the first basement floor 4 and the first floor 5 that have already been constructed in order to improve construction efficiency, for example, in the case where equipment such as electronics is provided in the electrical room 8b2, rain water can be more reliably prevented from flowing into the vicinity of the equipment by employing the funnel structure.

Next, a post-treatment of the temporary drainage system performed when the drainage of the multiple-story building is not required any more, particularly, a post-treatment of the floor slab penetration hole 16 will be described.

Figure 5:
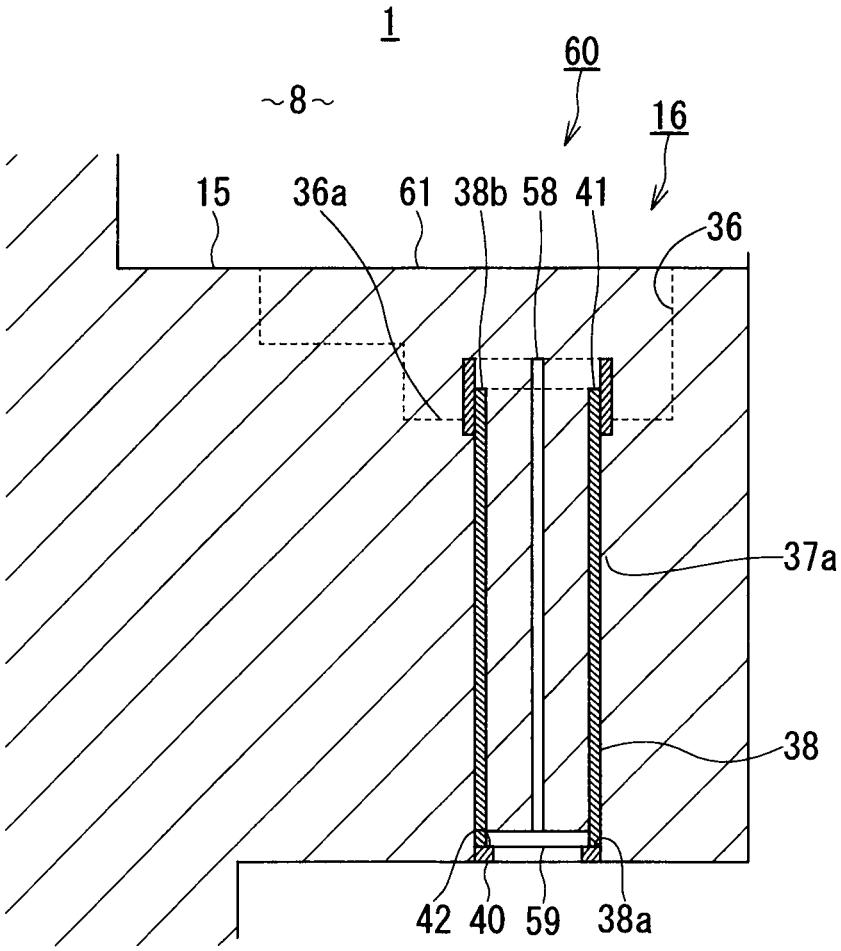
FIG. 5 is a partial sectional view of the multiple-story building illustrating a state in which the floor slab penetration hole of the temporary drainage system according to the present invention is closed.
Figure 6:
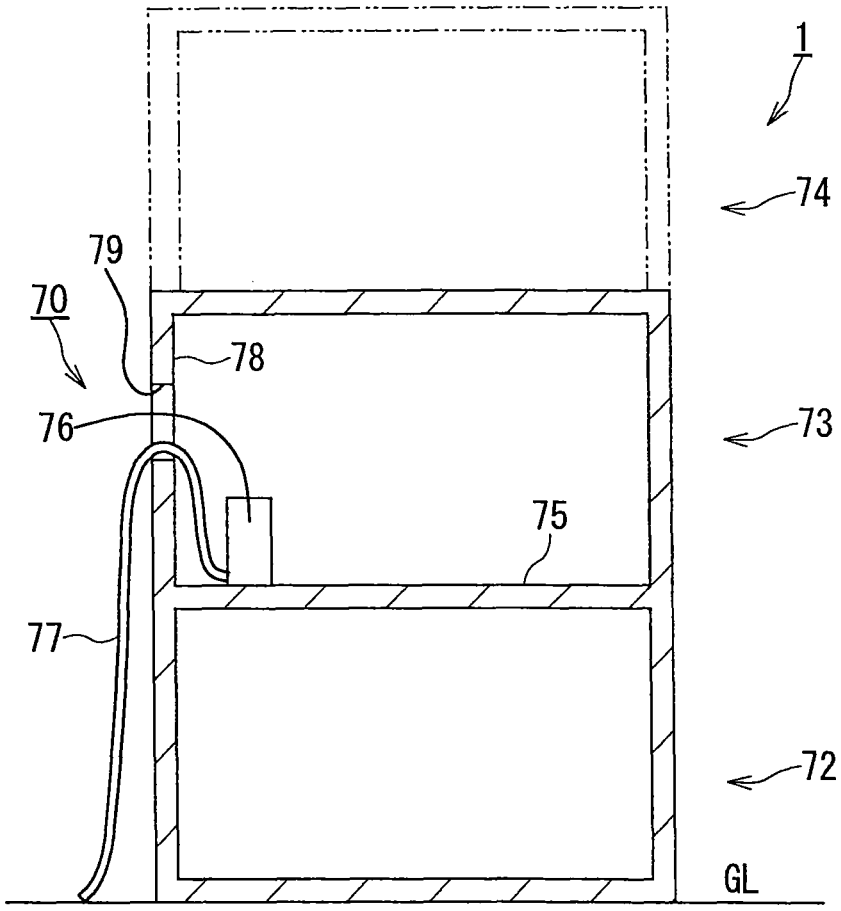
FIG. 6 PRIOR ART
FIG. 6 is a schematic configuration diagram illustrating a conventional drainage system.

FIG. 5 is a partial sectional view of the multiple-story building illustrating a state in which the floor slab penetration hole of the temporary drainage system according to the present invention is closed.

As shown in FIG. 5, the floor slab penetration hole 16 provided in the floor slab 15 of the multiple-story building 1 under construction is closed when there is no risk of inflow of rain water or the like.

When the floor slab penetration hole 16 is closed, the collection hose 18 is removed along with a hose connector portion 46 and a draining grating 49, first. Subsequently, a separately prepared penetration hole closing member 60, which is provided with a disk-shaped closing plate 59 at a distal end of a rod-shaped operation portion 58, is inserted downward through the funnel portion 36, the connection pipe portion 37, and the hose guide pipe portion 38 of the floor slab penetration hole 16, and is engaged with the inner flange portion 40 in a state when the closing plate 59 abuts against the inner flange portion 40.

Accordingly, a diameter of the closing plate 59 is formed smaller than an inner diameter of the hose guide pipe portion 38 and larger than a flange inner diameter of the inner flange portion 40.

Subsequently, mortar 61 as a repairing material is poured into the floor slab penetration hole 16 from the funnel portion 36.

The mortar 61 poured into the floor slab penetration hole 16 is blocked by the closing plate 59 to fill inside of the floor slab penetration hole 16 without leaking to the lower floor. When the mortar 61 is solidified, the floor slab penetration hole 16 is closed.

With the temporary drainage system 11 according to the present embodiment, the drainage water in the multiple-story building 1 is collected into the drainage pit 12 without using a dynamic component such as a pump. The drainage water collected into the drainage pit 12 is always collected through the sand-settling vessel 19 into the drainage pit 12. Thus, sand or the like hardly enters the first drainage pump 25 and the second drainage pump 26 for discharging the drainage water to outside the multiple-story building 1 from the drainage pit 12, so that the drainage water is easily discharged. Since the plurality of drainage pits 12 communicate with each other through the pit communicating pipe 23, it is not necessary to install the pump in each of the drainage pits 12. Accordingly, the structure of the temporary drainage system 11 can be simplified.

A filler in the present embodiment is not limited to the mortar, and a caulking compound or the like for preventing water leakage may be also employed. Any material other than the fillers employed in the present embodiment may be employed as long as the water leakage to the lower floor can be reliably prevented.

The invention claimed is:

1. A temporary drainage system for draining rain water that flows into a floor under construction to an outside of a building during construction of a multiple-story building, including a drainage collection unit and a drainage discharge unit, the drainage collection unit comprising:

a flexible drainage collection hose connected to a penetration hole formed in a floor slab of the floor under construction;

a drainage collection vessel provided on a floor slab of a constructed floor below the floor under construction of the building and connected to the drainage collection hose; and a drainage pit provided on a lowest floor of the building to collect drainage water discharged from the drainage collection vessel through a drainage hose, and the drainage discharge unit comprising:

a drainage pump provided in the drainage pit;

a drainage pipe connected to the drainage pump;

a drainage collection funnel provided in a floor slab of a constructed floor of the building; and a drainage collection riser pipe buried in the floor slab of the constructed floor of the building and a side wall of the building, wherein the drainage collection riser pipe is connected to the drainage collection funnel, wherein drainage water discharged from the drainage collection vessel is collected into the drainage pit through the riser pipe.

2. The temporary drainage system according to claim 1, wherein the drainage collection hose is connected to the penetration hole through a hose guide pipe.

3. The temporary drainage system according to claim 1, wherein the drainage collection vessel is a sand-settling vessel for separating water and sand.

4. A temporary drainage method for draining rain water that flows into a floor under construction to an outside of a building during construction of a multiple-story building, comprising the steps of:

providing a penetration hole in a floor slab of the floor under construction of the building;

draining water such as rain water on the floor slab of the floor under construction through a drainage hose connected to the penetration hole;

collecting the drainage water from the drainage hose into a drainage collection vessel provided on a floor slab of a constructed floor of the building;

providing a drainage collection funnel in the floor slab of the constructed floor of the building, and a drainage collection riser pipe buried in the floor slab of the constructed floor of the building and a side wall of the building, wherein the drainage collection riser pipe is connected to the drainage collection funnel;

collecting the drainage water discharged from the drainage collection vessel into a drainage pit provided on a lowest floor of the building, through the riser pipe;

discharging the drainage water from the drainage pit to the outside of the building.

5. The temporary drainage method according to claim 4, further comprising the step of closing the penetration hole after completion of final drainage.

6. The temporary drainage method according to claim 4, wherein the drainage collection vessel separates water and sand.

* * * * *

UNITED STATES PATENT AND TRADEMARK OFFICE

CERTIFICATE OF CORRECTION

PATENT NO. : 8,496,023 B2
APPLICATION NO. : 12/935123
DATED : July 30, 2013
INVENTOR(S) : Tsuyoshi Honda It is certified that error appears in the above-identified patent and that said Letters Patent is hereby corrected as shown below:

On the title page, Item (73), the Assignee's Information is incorrect. Item (73) should read:

--(73) Assignee: Toshiba Plant Systems & Services Corporation, Yokohama-Shi (JP)--

Signed and Sealed this
Nineteenth Day of November, 2013

Teresa Stanek Rea
*Deputy Director of the United States Patent and Trademark Office*